US010299317B2

(12) United States Patent
Okamura

(10) Patent No.: US 10,299,317 B2
(45) **Date of Patent: *May 21, 2019**

(54) HEATER AND GLOW PLUG PROVIDED WITH SAME

(71) Applicant: Kyocera Corporation, Kyoto-shi, Kyoto (JP)

(72) Inventor: Takeshi Okamura, Aira (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 249 days.

This patent is subject to a terminal disclaimer.

(21) Appl. No.: 15/287,376

(22) Filed: Oct. 6, 2016

(65) Prior Publication Data

US 2017/0127478 A1 May 4, 2017

Related U.S. Application Data

(63) Continuation of application No. 14/113,922, filed as application No. PCT/JP2012/061374 on Apr. 27, 2012, now Pat. No. 9,491,805.

(30) Foreign Application Priority Data

Apr. 27, 2011 (JP) ..... 2011-099603

(51) Int. Cl.
*F23Q 7/22* (2006.01)
*H05B 3/03* (2006.01)
(Continued)

(52) U.S. Cl.
CPC ..... *H05B 3/48* (2013.01); *F23Q 7/001* (2013.01); *F23Q 7/22* (2013.01); *H05B 3/141* (2013.01);
(Continued)

(58) Field of Classification Search
None
See application file for complete search history.

(56) References Cited

U.S. PATENT DOCUMENTS 3,662,222 A 5/1972 Ray
4,475,029 A 10/1984 Yoshida et al.
(Continued)

FOREIGN PATENT DOCUMENTS

CN 101647314 A 2/2010
EP 1255076 A2 11/2002
(Continued)

OTHER PUBLICATIONS

Extended European Search Report, European Patent Application No. 12776821.6, dated Sep. 1, 2014, 6 pp.
(Continued)

*Primary Examiner* — Joseph M Pelham
(74) *Attorney, Agent, or Firm* — Volpe and Koenig, P.C.

(57) ABSTRACT

The present disclosure is directed to a heater including: a resistor including a heat-generating portion; a lead joined to an end portion of the resistor; and an insulating base covering the resistor and the lead. The heater includes a connection portion in which the resistor and the lead overlap each other in a direction perpendicular to an axial direction of the lead, and a boundary between the resistor and the lead has a curved shape when the connection portion is seen in a cross section perpendicular to the axial direction.

6 Claims, 10 Drawing Sheets

(51) Int. Cl.

| | |
|---|---|
| ***H05B 3/48*** | (2006.01) |
| ***H05B 3/18*** | (2006.01) |
| ***F23Q 7/00*** | (2006.01) |
| ***H05B 3/14*** | (2006.01) |

(52) U.S. Cl.
CPC .. *H05B 2203/016* (2013.01); *H05B 2203/027* (2013.01)

(56) References Cited

U.S. PATENT DOCUMENTS

| | | | | |
|---|---|---|---|---|
| 4,661,686 | A * | 4/1987 | Yokoi | F23Q 7/001 123/145 A |
| 4,874,923 | A * | 10/1989 | Hatanaka | F23Q 7/001 219/270 |
| 4,929,813 | A * | 5/1990 | Masaka | F23Q 7/001 123/145 A |
| 5,059,768 | A * | 10/1991 | Hatanaka | F23Q 7/001 123/145 A |
| 5,998,765 | A * | 12/1999 | Mizuno | F23Q 7/001 123/145 A |
| 6,013,898 | A | 1/2000 | Mizuno et al. | |
| 6,653,601 | B2 | 11/2003 | Taniguchi et al. | |
| 6,689,990 | B2 | 2/2004 | Taniguchi et al. | |
| 6,737,612 | B2 | 5/2004 | Taniguchi et al. | |
| 7,164,103 | B2 | 1/2007 | Andersson et al. | |
| 7,282,670 | B2 | 10/2007 | Matsubara et al. | |
| 7,378,621 | B2 * | 5/2008 | Johansson | H05B 3/148 219/211 |
| 8,933,373 | B2 | 1/2015 | Yamamoto | |
| 2002/0162830 | A1 | 11/2002 | Taniguchi et al. | |
| 2002/0162831 | A1 | 11/2002 | Taniguchi et al. | |
| 2009/0320782 | A1 | 12/2009 | Hiura | |
| 2010/0078421 | A1 | 4/2010 | Burrows et al. | |
| 2013/0146579 | A1 | 6/2013 | Hiura | |
| 2013/0284714 | A1 | 10/2013 | Okamura et al. | |
| 2013/0291819 | A1 | 11/2013 | Yonetamari | |
| 2014/0053795 | A1 | 2/2014 | Hiura | |
| 2015/0048077 | A1 | 2/2015 | Kobayashi | |

FOREIGN PATENT DOCUMENTS

| | | | |
|---|---|---|---|
| EP | 2117280 | A1 | 11/2009 |
| EP | 2667686 | A1 | 11/2013 |
| JP | 03-149791 | A | 6/1991 |
| JP | 07-282960 | A | 10/1995 |
| JP | 2000-130754 | A | 5/2000 |
| JP | 2001-227744 | A | 8/2001 |
| JP | 2002-334768 | A | 11/2002 |
| JP | 2003-022889 | A | 1/2003 |
| JP | 2007-227063 | A | 9/2007 |
| JP | 2010-210134 | A | 9/2010 |
| KR | 1020090111805 | | 10/2009 |

OTHER PUBLICATIONS

JP2000-130754A, Masahiro et al, Ceramic Glow Plug, May 2000, partial translation.
Chinese Office Action with English concise explanation, Chinese Patent Application No. 201280020685.5, dated Jan. 4, 2015, 7 pgs.
Korean Office Action with English concise explanation, Korean Patent Application No. 10-2013-7026709, dated Sep. 1, 2014, 4 pp.
Third party observations according to Article 115 EPC with respect to European Patent Application No. 12776821.6, Jun. 3, 2014, 14 pp.

* cited by examiner

HEATER AND GLOW PLUG PROVIDED WITH SAME

CROSS REFERENCE TO RELATED APPLICATIONS

This application is a continuation of U.S. application Ser. No. 14/113,922 filed Oct. 25, 2013, which claims the benefit of PCT Patent Application No. PCT/JP2012/061374 filed Apr. 27, 2012, which claims priority to JP 2011-099603 filed Apr. 27, 2011, the entire contents of all of which are expressly incorporated by reference herein as if fully set forth.

TECHNICAL FIELD

The present invention relates to a ceramic heater used, for example, as an ignition or flame detection heater for combustion type onboard heating apparatus, an ignition heater for various combustion apparatuses such as kerosene fan heater, a heater for glow plug of automobile engine, a heater for various sensors such as oxygen sensor, or a heater for measuring instrument; and a glow plug provided with the same.

BACKGROUND ART

A heater used in such applications as glow plug of automobile engine includes a resistor including a heat-generating portion, a lead, and an insulating base. The materials for them are selected and the shapes of them are designed such that the resistance of the lead is lower than that of the resistor.

Here, a junction between the resistor and the lead is a point of change in shape at which the resistor and the lead having different shapes are connected to each other, or a point of change in material composition at which the resistor and the lead having different material compositions are connected to each other. Thus, modifications are made such as increasing the junction area in order to reduce the effect caused by a difference in thermal expansion produced by heat generation or cooling during use. For example, there is known a heater in which the interface between a resistor 3 and each lead 8 is tilted when being seen in a cross section parallel to the axial direction of the lead as shown in FIG. 10(*a*) (e.g., see Patent Literature 1 and 2).

CITATION LIST

Patent Literature

PTL 1: Japanese Unexamined Patent Application Publication No. 2002-334768

PTL 2: Japanese Unexamined Patent Application Publication No. 2003-22889

SUMMARY OF INVENTION

Technical Problem

In recent years, in order to optimize a combustion state of an engine, a driving method has been employed in which a control signal from an ECU is pulsed.

Here, a square wave is often used as a pulse. A high-frequency component is present in a rising portion of the pulse, and the high-frequency component propagates on a surface portion of a lead. However, when a joint portion (connection portion) is formed such that end surfaces of a lead and a resistor having different impedances are opposed to each other, a portion of the high-frequency component impedance of which portion cannot be matched at the connection portion is reflected and diffused at the connection portion, and dissipated as a Joule heat. Thus, heat is locally generated in the connection portion. However, when the interface between each lead 8 and the resistor 3 is flat as shown in FIG. 10(*b*), a problem arises that a micro crack occurs in the connection portion between each lead 8 and the resistor 3 due to the fact that the coefficient of thermal expansion of each lead is different from the coefficient of thermal expansion of the resistor, and the crack develops immediately along the interface between the lead 8 and the resistor 3, and the resistance value of the heater is changed in a short operation time.

In addition, even when pulse drive is not employed and DC drive is employed, the same problem arises. In other words, since circuit loss is decreased in a recent ECU, a high current flows through a resistor at start of an engine operation for the purpose of quick temperature rise. Therefore, rising at which power inrushes is steepened like a square wave of a pulse, and high power including a high-frequency component rushes into the heater. Thus, the same problem arises.

The present invention has been conceived of in view of the above-described problems of the related art, and an object thereof is to provide a highly-reliable and durable heater in which even when a high current flows through a resistor, occurrence of a micro crack in a connection portion between the resistor and a lead, development of a crack at an interface, and change in the resistance value of the heater are suppressed, and a glow plug provided with the same.

Solution to Problem

A heater according to the present invention is a heater including: an insulating base; a resistor buried in the insulating base; and a lead buried in the insulating base and connected at a front end side thereof to the resistor. A connection portion is provided such that an end surface of the resistor and an end surface of the lead are opposed to each other, and a boundary between the resistor and the lead has a curved shape when the connection portion is seen in a cross section perpendicular to the axial direction.

In addition, the present invention is a glow plug including any described heater having the above-described configuration; and a metallic retaining member which is electrically connected to the lead and retains the heater.

Advantageous Effects of Invention

According to the heater of the present invention, even when a high-frequency component propagates along the surface of the lead, occurrence of a micro crack in the connection portion between the resistor and the lead, development of a crack in the boundary surface, and change of the resistance value of the heater are suppressed, and the resistance value of the heater is stabilized over a long period of time. Thus, the reliability and the durability of the heater are improved.

DESCRIPTION OF EMBODIMENTS

Hereinafter, examples of embodiments regarding a heater according to the present invention will be described in detail with reference to the drawings.

Figure 1A:
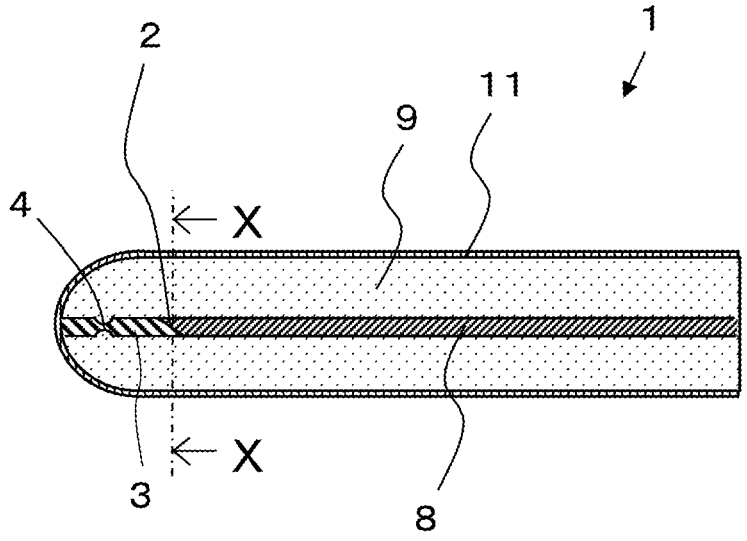
FIG. 1A is a longitudinal cross-sectional view showing an example of an embodiment of a heater according to the present invention.
Figure 1B:
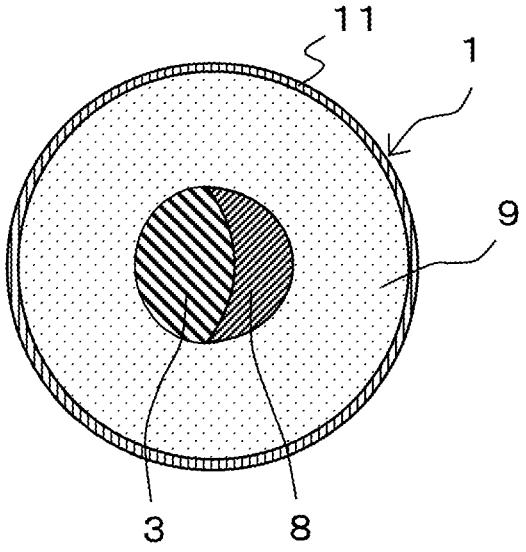
FIG. 1B is a transverse cross-sectional view taken along an X-X line shown in FIG. 1A.
Figure 2:
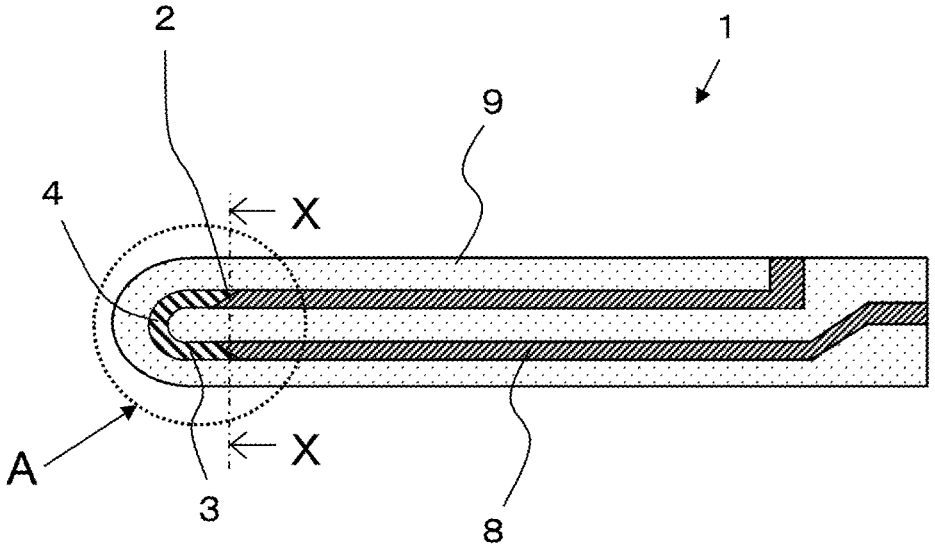
FIG. 2 is a longitudinal cross-sectional view showing another example of the embodiment of the heater according to the present invention.

FIG. 1(*a*) is a longitudinal cross-sectional view showing an example of the embodiment of the heater according to the present invention, and FIG. 1(*b*) is a transverse cross-sectional view taken along an X-X line shown in FIG. 1(*a*). In addition, FIG. 2 is a longitudinal cross-sectional view showing another example of the embodiment of the heater according to the present invention.

The heater 1 of the embodiment is a heater which includes an insulating base 9, a resistor 3 buried in the insulating base 9, and a lead 8 which is buried in the insulating base 9 and connected at a front end side thereof to the resistor 3. The heater 1 includes a connection portion 2 where the resistor 3 and the lead 8 overlap each other in a direction perpendicular to the axial direction of the lead 8, and the boundary between the resistor 3 and the lead 8 has a curved shape when the connection portion 2 is seen in a cross section perpendicular to the axial direction.

The insulating base 9 in the heater 1 of the embodiment is formed, for example, in a bar shape. The insulating base 9 covers the resistor 3 and the lead 8. In other words, the resistor 3 and the lead 8 are buried in the insulating base 9. Here, the insulating base 9 is preferably made of ceramics. Thus, the insulating base 9 is able to resist higher temperatures than metals, and hence it is possible to provide a heater 1 having further improved reliability in quick temperature rise. Specific examples thereof include ceramics having electrical insulating properties such as oxide ceramics, nitride ceramics, and carbide ceramics. Particularly, the insulating base 9 is preferably made of silicon nitride ceramics. This is because silicon nitride, which is a principal component, is good in terms of high strength, high toughness, high insulating properties, and heat resistance. It is possible to obtain the silicon nitride ceramics, for example, by mixing 3 to 12% by mass of a rare earth element oxide such as $Y_2O_3$, $Yb_2O_3$, or $Er_2O_3$ as a sintering aid, 0.5 to 3% by mass of $Al_2O_3$ with silicon nitride as the principal component, further mixing $SiO_2$ therewith such that an $SiO_2$ amount contained in a sintered body is 1.5 to 5% by mass, molding the mixture into a predetermined shape, and then conducting firing through hot pressing at, for example, 1650 to 1780° C.

In addition, when one made of silicon nitride ceramics is used as the insulating base 9, it is preferred that $MoSiO_2$, $WSi_2$, or the like is mixed and dispersed therein. In this case, it is possible to make the coefficient of thermal expansion of the silicon nitride ceramics as the base material to be close to the coefficient of thermal expansion of the resistor 3, and thus it is possible to improve the durability of the heater 1.

The resistor 3 includes a heat-generating portion 4 which is a region in which heat is particularly generated. When the resistor 3 has a linear shape as shown in FIG. 1(*a*), it is possible to make this region to be the heat-generating portion 4 by providing a region where a cross-sectional area is partially reduced or a region having a helical shape. It should be noted that in the embodiment shown in FIG. 1, the resistor 3 has a linear shape, an end of the resistor 3 is electrically connected to the lead 8, and the other end of the resistor 3 is electrically connected to a surface conductor 11 provided so as to cover the surface of the insulating base 9.

In addition, when the resistor 3 has a folded shape as shown in FIG. 2, a region of the resistor 3 between the leads 8 becomes the heat-generating portion 4, and a portion around the middle point of the folded portion becomes the heat-generating portion 4 that generates heat most.

One containing a carbide, a nitride, a silicide, or the like of W, Mo, Ti, or the like as a principal component may be used as the resistor 3. When the insulating base 9 is the above material, tungsten carbide (WC) among the above-described materials is good as the material of the resistor 3 in that the difference in coefficient of thermal expansion from the insulating base 9 is small, in having a high heat resistance, and in having a low specific resistance. Furthermore, when the insulating base 9 is made of silicon nitride ceramics, the resistor 3 preferably contains, as a principal component, WC which is an inorganic conductor, and the amount of silicon nitride added thereto is preferably equal to or greater than 20% by mass. For example, in the insulating base 9 made of silicon nitride ceramics, tensile stress is generally applied to a conductor component which is to be the resistor 3, since the conductor component has a higher coefficient of thermal expansion than that of silicon nitride.

On the other hand, when silicon nitride is added to the resistor 3, it is possible to make the coefficient of thermal expansion of the resistor 3 to be close to the coefficient of thermal expansion of the insulating base 9 and to alleviate stress caused by a difference in coefficient of thermal expansion in temperature rise or temperature fall of the heater 1.

In addition, when the amount of silicon nitride contained in the resistor 3 is equal to or less than 40% by mass, it is possible to make the resistance value of the resistor 3 relatively small and stabilize the resistance value. Therefore, the amount of silicon nitride contained in the resistor 3 is preferably 20% by mass to 40% by mass. More preferably, the amount of silicon nitride is 25% by mass to 35% by mass. Moreover, instead of silicon nitride, boron nitride may be added in an amount of 4% by mass to 12% by mass as a similar additive to the resistor 3.

Figure 3A:
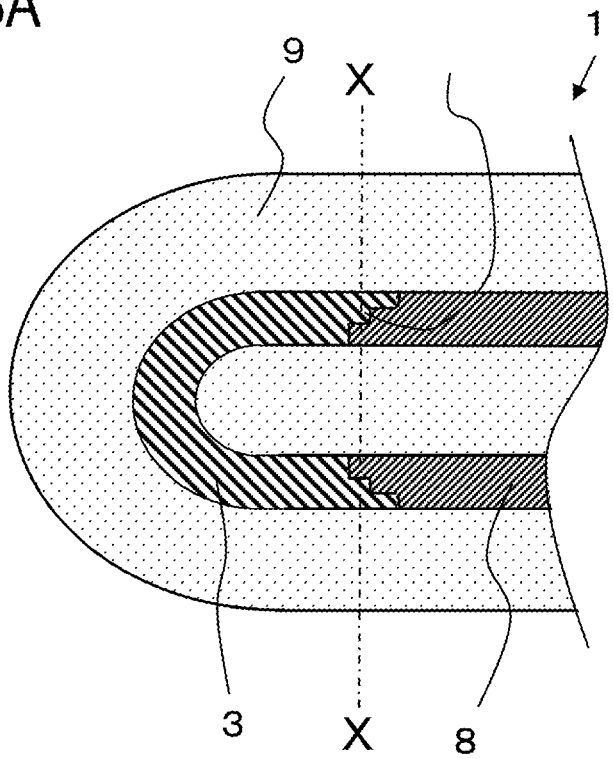
FIG. 3A is an enlarged longitudinal cross-sectional view of an example of a region A including a connection portion between a resistor and each lead shown in FIG. 2.
Figure 3B:
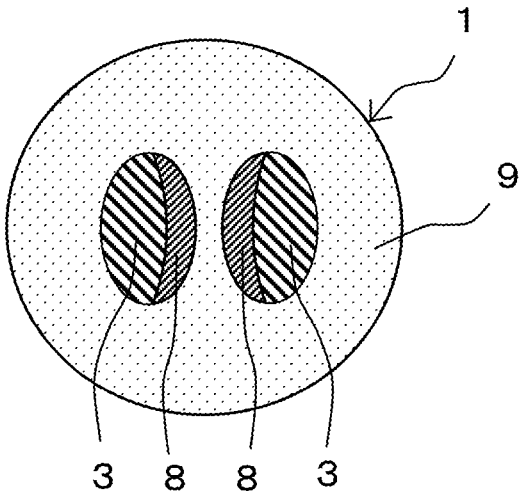
FIG. 3B is a transverse cross-sectional view taken along an X-X line shown in FIG. 3A.

In addition, the thickness of the resistor 3 (the thickness in the up-down direction shown in FIGS. 1(*b*) and 3(*b*)) is preferably 0.5 mm to 1.5 mm, and the width of the resistor 3 (the width in the horizontal direction shown in FIG. 3(*b*)) is preferably 0.3 mm to 1.3 mm. By being set within these ranges, the resistance of the resistor 3 is decreased, and the resistor 3 efficiently generates heat. Moreover, when the insulating base 9 has a lamination structure formed, for example, by laminating halved molded bodies, it is possible to keep the adhesiveness at the lamination interface of the insulating base 9 having the lamination structure.

The same material as that of the resistor 3 containing a carbide, a nitride, a silicide, or the like of W, Mo, Ti, or the like as a principal component may be used for the lead 8 which is connected at the front end side thereof to the end portion of the resistor 3. Particularly, WC is preferred as the material of the lead 8 in that the difference in coefficient of thermal expansion from the insulating base 9 is small, in having a high heat resistance, and in having a low specific resistance. In addition, when the insulating base 9 is made of silicon nitride ceramics, the lead 8 preferably contains, as a principal component, WC which is an inorganic conductor, and silicon nitride is preferably added thereto in an amount of equal to or greater than 15% by mass. It is possible to make the coefficient of thermal expansion of the lead 8 to be closer to the coefficient of thermal expansion of the insulating base 9 as the amount of silicon nitride is increased. In addition, when the amount of silicon nitride is equal to or less than 40% by mass, the resistance value of the lead 8 is decreased and stabilized. Therefore, the amount of silicon nitride is preferably 15% by mass to 40% by mass. More preferably, the amount of silicon nitride is 20% by mass to 35% by mass. It should be noted that the resistance value of the lead 8 per unit length may be made lower than that of the resistor 3 by making the amount of the forming material of the insulating base 9 smaller than that of the resistor 3, or by making the cross-sectional area of the lead 8 larger than that of the resistor 3.

The connection portion 2 is provided such that the resistor 3 and the lead 8 overlap each other in the direction perpendicular to the axial direction of the lead 8. It should be noted that the connection portion 2 refers to a region where the interface between the resistor 3 and the lead 8 is present, when being seen in a cross section parallel to the axis direction of the lead 8. For example, as shown in FIGS. 1 and 2, the connection portion 2 is provided such that the boundary line between the end surface of the resistor 3 and the end surface of the lead 8 is tilted relative to the axial direction of the lead 8 when being seen in a longitudinal cross section parallel to the axial direction of the lead 8, in order to increase the junction area between the end surface of the resistor 3 and the end surface of the lead 8. It should be noted that the tilt angle of the boundary line relative to the axial direction is, for example, 10 to 80 degrees.

Furthermore, the boundary between the resistor 3 and the lead 8 has a curved shape when the connection portion 2 is seen in a cross section perpendicular to the axial direction. In other words, the boundary surface between the resistor 3 and the lead 8 is a curved surface.

With such a configuration, a portion of a high-frequency component having propagated along the surface of the lead 8 the impedance of which portion cannot be matched at the connection portion 2 between the lead 8 and the resistor 3 is reflected and diffused at the connection portion 2, and dissipated as a Joule heat, and heat is locally generated in the connection portion 2. At that time, when the boundary between the resistor 3 and the lead 8 connected to each other has a curved shape, it is possible to make the directions of stress within the boundary surface, which is caused due to the fact that the coefficient of thermal expansion of the lead 8 is different from the coefficient of thermal expansion of the resistor 3, to be different from each other. Therefore, regardless of pulse drive or DC drive, even when rising at which power inrushes is steepened, occurrence of a micro crack in the connection portion 2 between the lead 8 and the resistor 3 is suppressed, a crack occurring in the boundary surface between the lead 8 and the resistor 3 is restrained from developing immediately, and the resistance value of the heater 1 is stabilized over a long period of time.

In other words, even with a driving method in which a control signal from an ECU is pulsed, occurrence of a micro crack in the connection portion 2 between the lead 8 and the resistor 3 is suppressed, a crack does not develop immediately in the boundary surface between the lead 8 and the resistor 31, and the resistance value of the heater 1 is stabilized over a long period of time.

In addition, even when pulse drive is not employed and DC drive is employed, the same advantageous effects are obtained. Specifically, when a high current is passed through the resistor at start of an engine operation for the purpose of quick temperature rise, rising at which power inrushes is steepened like a square wave of a pulse, and high power including a high-frequency component rushes into the heater. However, even when high power including a high-frequency component rushes into the heater, occurrence of a micro crack in the connection portion 2 between the lead 8 and the resistor 3 is suppressed, a crack does not develop immediately in the boundary surface between the lead 8 and the resistor 31, and the resistance value of the heater 1 is stabilized over a long period of time.

In addition, in the heater 1 shown in FIG. 3, the resistor 3 has a folded shape, and the connection portion 2 between the resistor 3 and each lead 8 fitted to each other is tilted relative to the axial direction by providing steps on the boundary surface therebetween in order to be able to strengthen the connection portion 2. It should be noted that the steps appear when being seen in a longitudinal cross section parallel to the axial direction.

As described above, with the configuration in which even though the steps are provided, the boundary between the resistor 3 and each lead 8 joined to each other has a curved shape when the connection portion 2 is seen in a cross section perpendicular to the axial direction, a structure is provided in which a shield is provided at 90□°□ for each step, and thus it is possible to further suppress a crack.

Figure 4A:
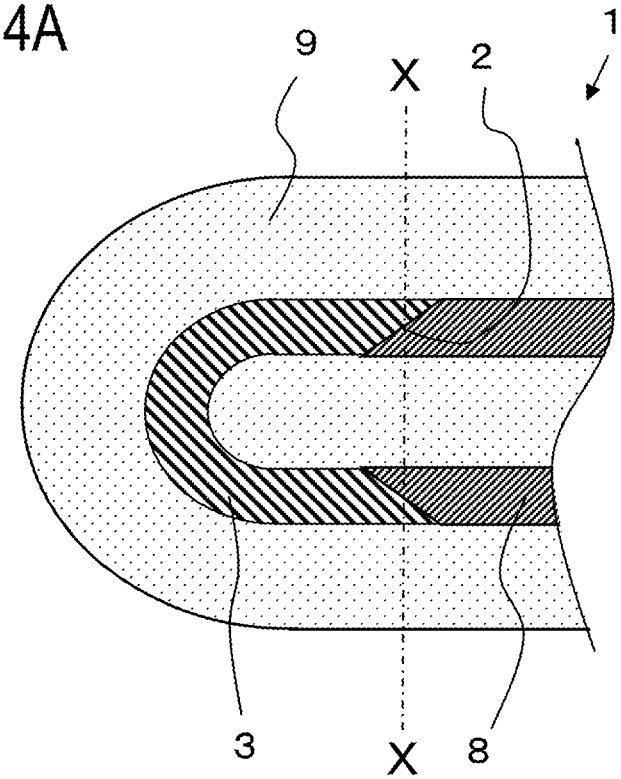
FIG. 4A is an enlarged longitudinal cross-sectional view of another example of the region A including the connection portion between the resistor and each lead shown in FIG. 2.
Figure 4B:
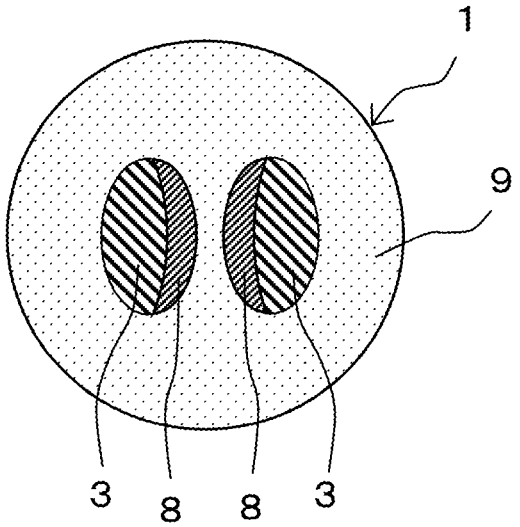
FIG. 4B is a transverse cross-sectional view taken along an X-X line shown in FIG. 4A.

Furthermore, in the heater 1 shown in FIG. 4, the resistor 3 has a folded shape, and boundaries between the resistor 3 and the leads 8 when being seen in a cross section perpendicular to the axial direction are paired and have a curved shape so as to be convex at the lead 8 side. With such a configuration, heat is distributed such that the center side of the heater 1 is hot, by utilizing the fact that Joule heat is likely to be generated at the lead side of the boundary with the resistor 3 when a high-frequency component is reflected. By so doing, compressive stress is applied from the insulating base 9, thus it is possible to suppress formation of a crack, and the resistance value of the heater 1 is stabilized over a long period of time.

Particularly, when a high DC current is passed through the resistor 3 at start of an engine operation for the purpose of quick temperature rise, rising at which power inrushes is steepened like a square wave of a pulse, and high power including a high-frequency component rushes into the heater. However, by making the rear end side of the connection portion 2 to have such a structure (have a curved shape so as to be convex at the lead 8 side), even when high power including a high-frequency component rushes into the heater, occurrence of a micro crack in the connection portion 2 between each lead 8 and the resistor 3 is suppressed, a crack does not develop immediately in the boundary surface between each lead 8 and the resistor 31, and the resistance value of the heater 1 is stabilized over a long period of time.

Furthermore, the cathode side of the heater 1 is grounded and a high DC current is passed through the resistor 3 at start of an engine operation for the purpose of quick temperature rise, a potential difference rapidly occurs between the anode side and the cathode side, electrons momentarily and rapidly flows in from the grounded cathode side, and thus the temperature rises at the cathode side earlier than at the anode side. Because of this, by making not only the connection portion 2 at the anode side but also the connection portion 2 at the cathode side to have such a structure (have a curved shape so as to be convex at the lead 8 side), heat is transmitted to the center of the heater and is distributed such that the center side is hot. By so doing, compressive stress is applied from the insulator, thus no crack occurs along the boundary surface between each lead 8 and the resistor 3, and the resistance value of the heater 1 is stabilized over a long period of time.

It should be noted that even with a driving method in which a control signal from an ECU is pulsed, the same advantageous effects are obtained.

Figure 5A:
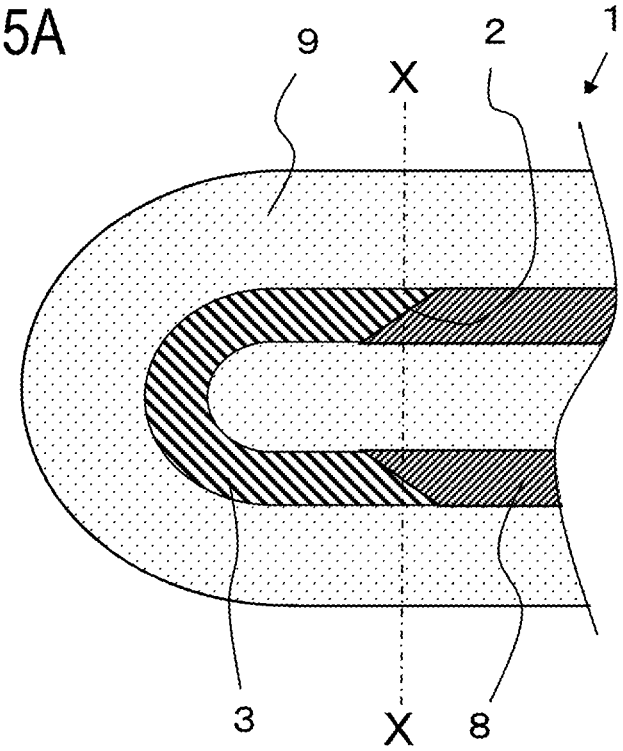
FIG. 5A is an enlarged longitudinal cross-sectional view of still another example of the region A including the connection portion between the resistor and each lead shown in FIG. 2.
Figure 5B:
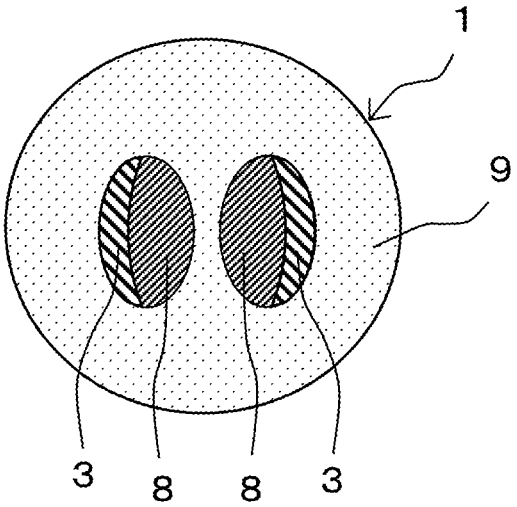
FIG. 5B is a transverse cross-sectional view taken along an X-X line shown in FIG. 5A.

Meanwhile, as shown in FIG. 5, the boundary between the resistor 3 and each lead 8 at least at the front end side of the connection portion 2 when being seen in a cross section perpendicular to the axial direction may have a curved shape so as to be convex at the resistor 3 side. With this configuration, the following advantageous effects are also provided in addition to the effect that even when a high-frequency component having propagated along the surface of the lead 8 is reflected at the connection portion between the lead 8 and the resistor 3 due to impedance mismatching and heat is locally generated, the direction of stress caused by the thermal expansion difference is bent within the boundary surface, thus occurrence of a micro crack is suppressed, and a crack occurring in the boundary surface does not develop immediately.

When a short time elapses after start of passing of current, generation of heat is started from the heat generation region at the front end side of the heater 1 to cause the temperature to be higher than that of the connection portion 2, and the temperature of the resistor 3 becomes high earlier than each lead 8. Here, since the boundary between the resistor 3 and each lead 8 at least at the front end side of the connection portion 2 when being seen in a cross section perpendicular to the axial direction has a curved shape so as to be convex at the resistor 3 side, when heat of the resistor 3 is transmitted to the lead 8 side, the heat is transmitted such that the resistor 3 encompasses the lead 8. Thus, compressing stress, not tensile stress, is applied to the interface portion, and it is possible to suppress a crack in the interface.

Figure 6A:
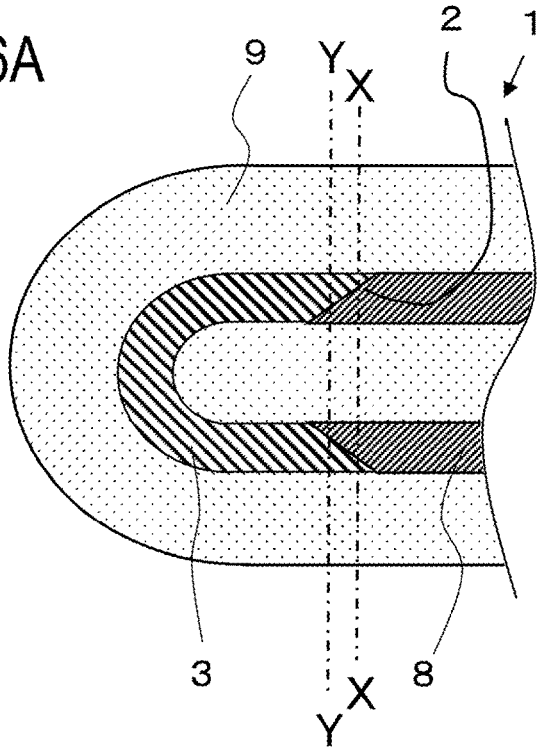
FIG. 6A is an enlarged longitudinal cross-sectional view of still another example of the region A including the connection portion between the resistor and each lead shown in FIG. 2.
Figure 6B:
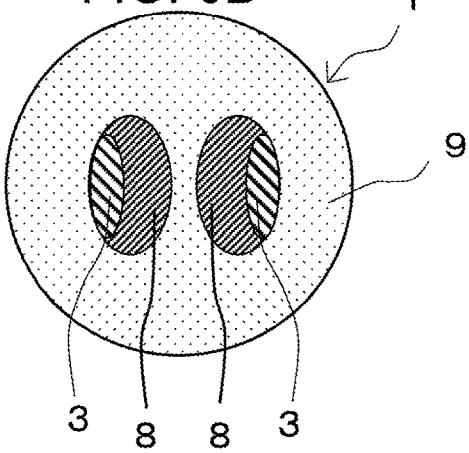
FIG. 6B is a transverse cross-sectional view taken along an X-X line shown in FIG. 6A.
Figure 6C:
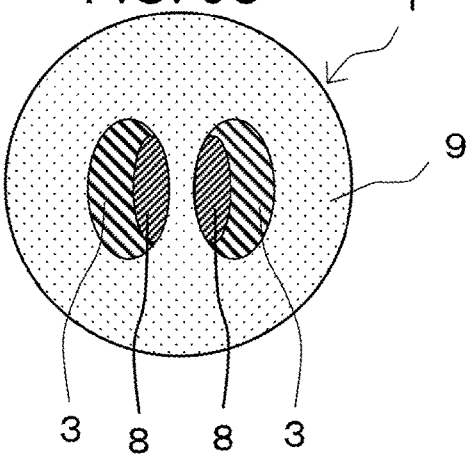
FIG. 6C is a transverse cross-sectional view taken along a Y-Y line shown in FIG. 6A.

Particularly, the following advantageous effects are obtained when the boundary between the resistor 3 and each lead 8 at the rear end side of the connection portion 2 (the lead 8 side) when being seen in a cross section perpendicular to the axial direction has a curved shape so as to be convex at the lead 8 side as shown in FIG. 6(*b*), or when the boundary between the resistor 3 and each lead 8 at the front end side of the connection portion 2 (the resistor 3 side) has a curved shape so as to be convex at the resistor 3 side as shown in FIG. 6(*c*).

In an initial stage when a high DC current is passed through the resistor 3 at start of an engine operation for the purpose of quick temperature rise, rising at which power inrushes is steepened like a square wave of a pulse, and high power including a high-frequency component rushes into the heater 1. Even when the high power including the high-frequency component rushes into the heater 1, occurrence of a micro crack in the connection portion 2 between each lead 8 and the resistor 3 is suppressed, and a crack does not develop immediately in the boundary surface between each lead 8 and the resistor 3. In addition, when, after start of passing of current, a short time elapses and generation of heat is started from the heat generation region at the front end side of the heater 1 to cause the temperature to be higher than that of the connection portion 2, the temperature of the resistor 3 becomes high earlier than each lead 8, and thus it is possible to alleviate stress.

As described above, it is possible to suppress occurrence of a micro crack in the connection portion 2, thus a crack odes not develop along the boundary surface, and the resistance value of the heater 1 is stabilized over a long period of time.

Figure 7A:
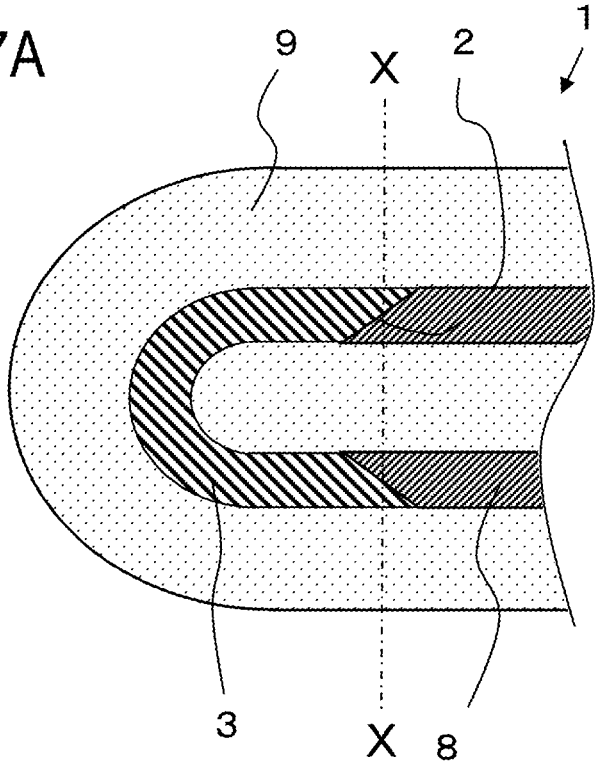
FIG. 7A is an enlarged longitudinal cross-sectional view of still another example of the region A including the connection portion between the resistor and each lead shown in FIG. 2.
Figure 7B:
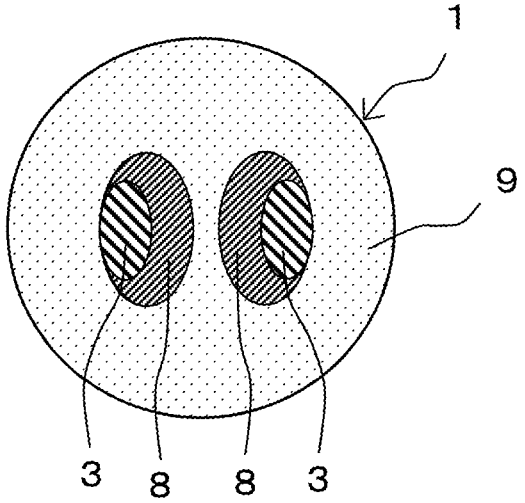
FIG. 7B is a transverse cross-sectional view taken along an X-X line shown in FIG. 7A.

In addition, as shown in FIG. 7, the boundary between the resistor 3 and each lead 8 in the connection portion 2 when being seen in a cross section perpendicular to the axial direction has such a curved shape that a portion of the resistor 3 is surrounded by the lead 8. Thus, reflection of a current is dispersed and generation of Joule heat is dispersed. In addition, the effect of bending the direction of stress is great, and stress is confined even when the resistor 3 expands. As a result, development of a crack does not occur. As described above, it is possible to inhibit formation of a micro crack in the connection portion 2, and a crack does not develop along the boundary surface between each lead 8 and the resistor 3. Therefore, the resistance value of the heater 1 is stabilized over a long period of time.

Figure 8A:
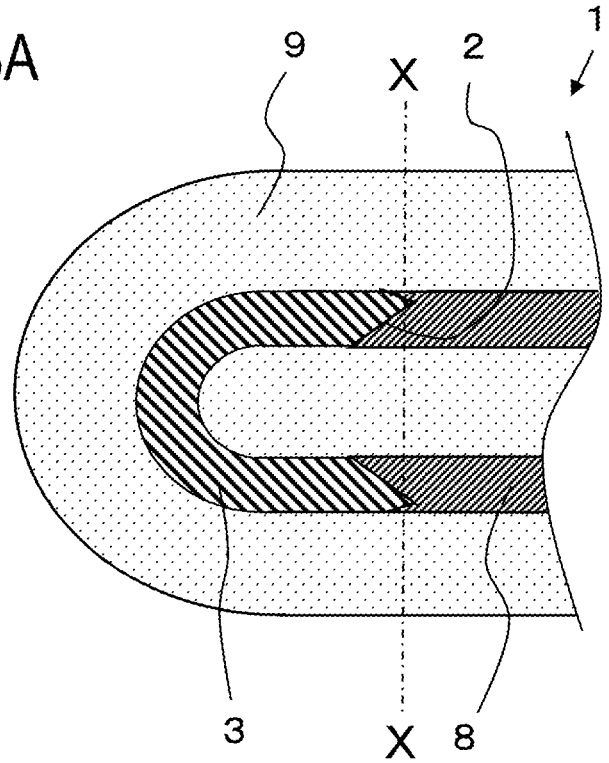
FIG. 8A is an enlarged longitudinal cross-sectional view of still another example of the region A including the connection portion between the resistor and each lead shown in FIG. 2.
Figure 8B:
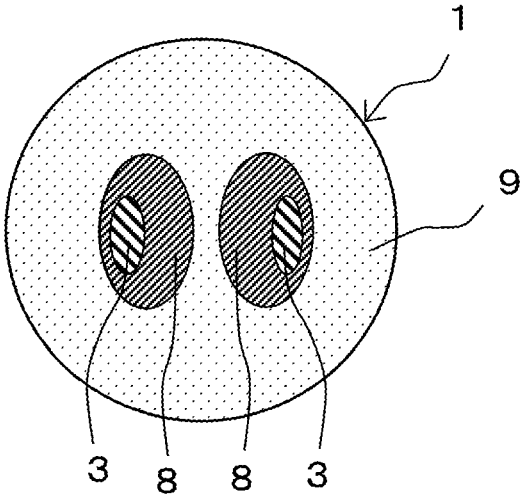
FIG. 8B is a transverse cross-sectional view taken along an X-X line shown in FIG. 8A.

Particularly, as shown in FIG. 8, the boundary between the resistor 3 and each lead 8 in the connection portion 2 when being seen in a cross section perpendicular to the axial direction has such a curved shape that the entirety of the resistor 3 is surrounded by the lead 8. Thus, it is possible to completely confine stress even when the resistor 3 thermally expands. Furthermore, a portion of a high-frequency component having propagated along the surface of the lead 8 the impedance of which portion cannot be matched at the connection portion 2 with the resistor 3 is reflected at the connection portion 2 and dissipated as Joule heat, and heat is locally generated in the connection portion 2. At that time, when the resistor 3 is enclosed by each lead 8 at the rear end side of the connection portion 2, a current reflected at the connection portion 2 is diffused radially, and it is possible to enhance the effect of dissipating Joule heat. As a result, a micro crack is less likely to occur in the connection portion 2 between each lead 8 and the resistor 3, a crack is restrained from developing along the boundary surface immediately, and the resistance value of the heater 1 is stabilized over a long period of time.

Figure 9:
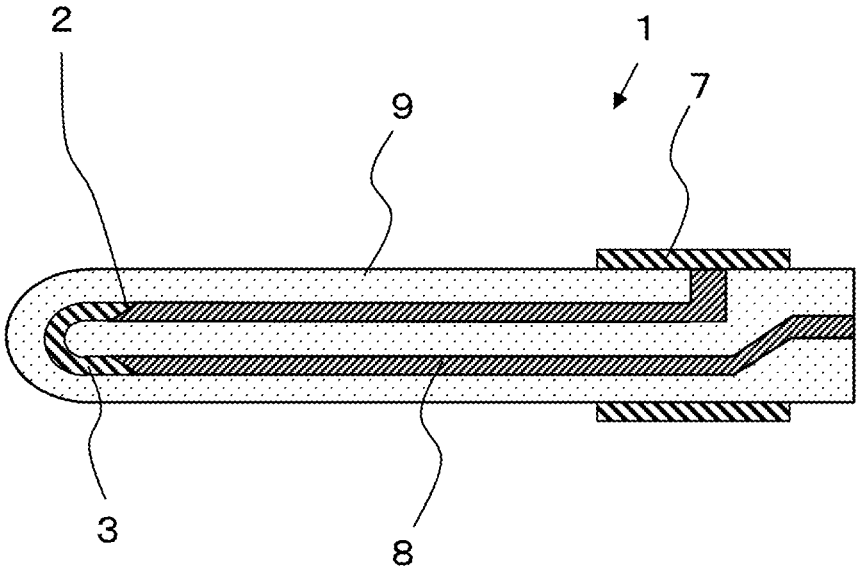
FIG. 9 is a schematic longitudinal cross-sectional view showing an example of an embodiment of a glow plug according to the present invention.
Figure 10A:
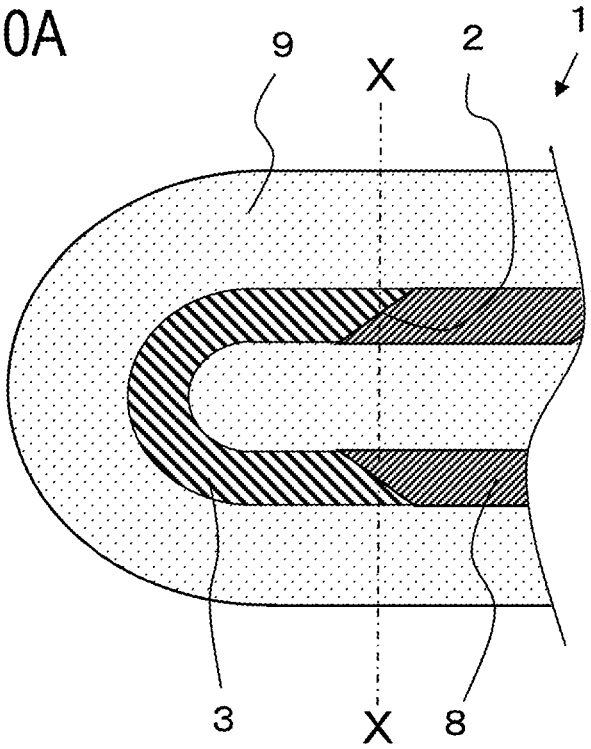
FIG. 10A is an enlarged longitudinal cross-sectional view showing a principal part of an existing heater.
Figure 10B:
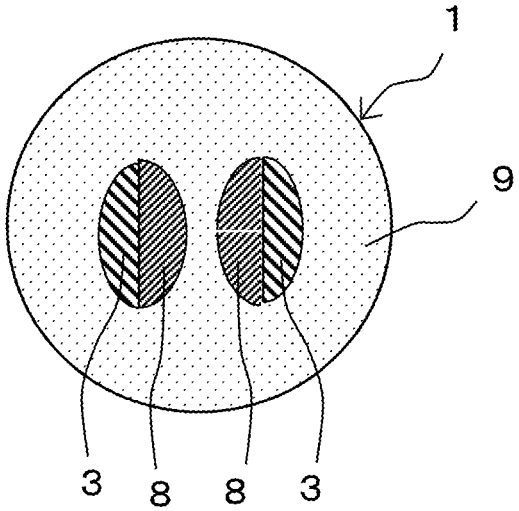
FIG. 10B is a transverse cross-sectional view taken along an X-X line shown in FIG. 10A.

In addition, as shown in FIG. 9, the heater 1 according to the embodiment is preferably used as a glow plug including the heater 1 and a metallic retaining member 7 which is electrically connected to a terminal portion (not shown) of the lead 8 and retains the heater 1. Specifically, the heater 1 is preferably used as a glow plug in which the resistor 3 having a folded shape is buried within the bar-shaped insulating base 9, in which a pair of the leads 8 are buried within the bar-shaped insulating base 9 so as to be electrically connected to both end portions, respectively, of the resistor 3, and which includes a metallic retaining member 7 (sheath metal fitting) electrically connected to one of the leads 8 and a wire electrically connected to the other lead 8.

It should be noted that the metallic retaining member 7 (sheath metal fitting) is a metallic cylindrical body which retains the heater 1, and is joined to one of the leads 8 which is drawn out to the side surface of the ceramic base 9, by a solder material. In addition, the wire is joined to the other lead 8 drawn out to the rear end of another ceramic base 9. Thus, even when long-term use is made while ON/OFF is repeated in an engine at a high temperature, the resistance of the heater 1 is not changed. Therefore, it is possible to provide a glow plug which has good ignitability at any time.

Next, a method for manufacturing the heater 1 according to the embodiment will be described.

The heater 1 according to the embodiment may be formed by, for example, an injection molding method or the like using molds having the shapes of the resistor 3, the lead 8, and the insulating base 9.

First, a conductive paste which contains conductive ceramic powder, a resin binder, and the like and is to be the resistor 3 and the lead 8 is prepared, and a ceramic paste which contains insulating ceramic powder, a resin binder, and the like and is to be the insulating base 9 is prepared.

Next, a molded body of the conductive paste having a predetermined pattern which is to be the resistor 3 (a molded body a) is formed by an injection molding method or the like using the conductive paste. Then, in a state where the molded body a is retained within a mold, the conductive paste is injected into the mold to form a molded body of the conductive paste having a predetermined pattern which is to be the lead 8 (a molded body b). Thus, a state is provided in which the molded body a and the molded body b connected to the molded body a are retained within the mold.

Next, in the state where the molded body a and the molded body b are retained within the mold, a portion of the mold is replaced with a mold for molding the insulating base 9, and then the ceramic paste which is to be the insulating base 9 is injected into the mold. Thus, a molded body of the heater 1 (a molded body d) in which the molded body a and the molded body b are covered with a molded body of the ceramic paste (a molded body c) is obtained.

Next, the obtained molded body d is fired, for example, at a temperature of 1650° C. to 1800° C. under a pressure of 30 MPa to 50 MPa, whereby it is possible to produce the heater 1. The firing is preferably conducted in a non-oxidizing gas atmosphere such as hydrogen gas.

EXAMPLES

Heaters according to examples of the present invention were produced as follows.

First, injection molding of a conductive paste containing 50% by mass of tungsten carbide (WC) powder, 35% by mass of silicon nitride ($Si_3N_4$) powder, and 15% by mass of a resin binder was conducted within a mold to produce a molded body a which is to be a resistor.

Next, in a state where the molded body a was retained within a mold, the above conductive paste which is to be the lead was injected into the mold to be connected to the molded body a, to form a molded body b which is to be the lead. At that time, as shown in FIGS. 1 and 2, junctions of six shapes between the resistor and each lead were formed using molds having various shapes.

Next, in a state where the molded body a and the molded body b were retained within a mold, injection molding of a ceramic paste containing 85% by mass of silicon nitride ($Si_3N_4$) powder, 10% by mass of an oxide ($Yb_2O_3$) of ytterbium (Yb) as a sintering aid, and 5% by mass of tungsten carbide (WC) for making a coefficient of thermal expansion to be close to those of the resistor and each lead was conducted within the mold. By so doing, a molded body d was formed which has a configuration in which the molded body a and the molded body b are buried in a molded body c which is to be an insulating base.

Next, the obtained molded body d was placed into a cylindrical mold made of carbon, and then sintered by conducting hot pressing at 1700° C. under a pressure of 35 MPa in a non-oxidizing gas atmosphere composed of nitrogen gas to produce a heater. A metallic cylindrical retaining member was soldered to a lead end portion (terminal portion) exposed on the surface of the obtained sintered body, to produce a glow plug.

A pulse pattern generator was connected to an electrode of the glow plug, a rectangular pulse having an applied voltage of 7 V, a pulse width of 10 μs, and a pulse interval of 1 μs was continuously passed therethrough. After 1000 hours elapsed, the change rate of the resistance value before and after the current passing ((resistance value after current passing−resistance value before current passing)/resistance value before current passing) was measured. The results are shown in Table 1.

TABLE 1

| Sample number | Shape of junction | Cross-sectional area of heat-generating portion of resistor ($mm^2$) | Location where heat is generated most | Resistance change rate (%) | Crack between resistor and lead |
|---|---|---|---|---|---|
| *1 | FIG. 9 | 0.60 | Junction between lead and resistor | 55 | None |
| 2 | FIG. 4 | 0.60 | Heat-generating portion of resistor | 5 | Presence |
| 3 | FIG. 6 | 0.60 | Heat-generating portion of resistor | 1 | Presence |
| 4 | FIG. 7 | 0.60 | Heat-generating portion of resistor | 1 | Presence |

As shown in Table 1, in Sample number 1, the location where heat was generated most was a connection portion between the lead and the resistor. When a pulse waveform flowing through the heater of Sample number 1 was checked with an oscilloscope in order to check a conduction state, rising of the pulse was not steepened unlike an input waveform, and 1 μs was taken until reaching 7V, and the waveform was wavy with overshoot.

This is thought that in the heater of Sample number 1, a high-frequency component contained in a rising portion of the pulse was reflected at the boundary surface between the lead and the resistor, since its impedance was not matched at the boundary surface. In addition, the reason why the location in the heater where heat was generated most was the connection portion between the lead and the resistor is thought to be that heat was locally generated in the connection portion between the lead and the resistor due to the reflection of the high-frequency component.

Furthermore, the resistance change in Sample number 1 between before and after the current passing was 55% and very great. Thus, when the connection portion between the lead and the resistor in Sample number 1 was observed with a scanning electron microscope after the pulse passing, it was confirmed that a micro crack occurred in the boundary surface from an outer peripheral direction toward the inside.

Meanwhile, in Sample numbers 2 to 4, the location where heat was generated most was the resistor heat-generating portion at the heater front end. When a pulse waveform flowing through the heater was checked with an oscilloscope in order to check a conduction state, rising of the pulse was substantially the same as an input waveform.

This shows that the current was able to flow through the connection portion between the lead and the resistor without abnormally generating heat in the connection portion.

In addition, the resistance changes in Sample numbers 2 to 4 between before and after the current passing were equal to or less than 5% and were small. When the connection portion between the lead and the resistor in these sample numbers was observed with a scanning electron microscope after the pulse passing, no micro crack was observed.

REFERENCE SIGNS LIST

1 heater
2 connection portion
3 resistor
4 heat-generating portion
7 metallic retaining member
8 lead
9 insulating base
11 surface conductor

The invention claimed is:

1. A heater comprising:
an insulating base;
a resistor buried in the insulating base; and
a lead buried in the insulating base and connected to a front end side of the resistor, wherein
the heater includes a connection portion in which the resistor and the lead overlap each other in a direction perpendicular to an axial direction of the lead,
a boundary between the resistor and the lead comprises a convex shape when the connection portion is seen in a cross section perpendicular to the axial direction,
the lead decreases in width and thickness within the connection portion as the lead extends in the axial direction, and
the boundary between the resistor and the lead at least at a rear end side of the connection portion when being seen in a cross section perpendicular to the axial direction is convex at a lead side.

2. The heater according to claim 1, wherein an outline of the lead and an outline of the resistor are continuous with each other when the connection portion is seen in a cross section perpendicular to the axial direction.

3. A glow plug comprising:
the heater according to claim 1; and
a metallic retaining member which is electrically connected to the lead and retains the heater.

4. A heater comprising:
an insulating base;
a resistor buried in the insulating base; and
a lead buried in the insulating base and connected to a front end side of the resistor, wherein
the heater includes a connection portion in which the resistor and the lead overlap each other in a direction perpendicular to an axial direction of the lead,
a boundary between the resistor and the lead comprises a convex shape when the connection portion is seen in a cross section perpendicular to the axial direction,
the lead decreases in cross-sectional area within the connection portion as the lead extends in the axial direction, and
the boundary between the resistor and the lead at least at a rear end side of the connection portion when being seen in a cross section perpendicular to the axial direction is convex at a lead side.

5. The heater according to claim 4, wherein an outline of the lead and an outline of the resistor are continuous with each other when the connection portion is seen in a cross section perpendicular to the axial direction.

6. A glow plug comprising:
the heater according to claim 4; and
a metallic retaining member which is electrically connected to the lead and retains the heater.

* * * * *